US009493332B2

(12) United States Patent
Kraft

(10) Patent No.: US 9,493,332 B2
(45) Date of Patent: Nov. 15, 2016

(54) FUNNEL SYSTEM WITH INTERCHANGEABLE COLLARS

(71) Applicant: David R. Kraft, Gig Harbor, WA (US)

(72) Inventor: David R. Kraft, Gig Harbor, WA (US)

( * ) Notice: Subject to any disclaimer, the term of this patent is extended or adjusted under 35 U.S.C. 154(b) by 73 days.

(21) Appl. No.: 14/637,172

(22) Filed: Mar. 3, 2015

(65) Prior Publication Data

US 2016/0257547 A1 Sep. 8, 2016

(51) Int. Cl.
*B67C 11/02* (2006.01)
*B67C 11/00* (2006.01)

(52) U.S. Cl.
CPC ..... *B67C 11/02* (2013.01); *B67C 2011/30* (2013.01)

(58) Field of Classification Search
CPC ..... B67C 11/02; B67C 2011/30
USPC ..... 141/331–345
See application file for complete search history.

(56) References Cited

U.S. PATENT DOCUMENTS

| | | | | |
|---|---|---|---|---|
| 313,049 | A | 3/1885 | Bolus et al. | |
| 990,549 | A | 4/1911 | Hampel | |
| 1,226,722 | A * | 5/1917 | Sullivan | B65D 83/06 141/268 |
| 4,494,585 | A | 1/1985 | Waldecker | |
| 4,823,848 | A * | 4/1989 | Sentmore, Sr. | B67C 11/00 141/334 |
| 5,228,488 | A * | 7/1993 | Fletcher | B67C 11/04 141/331 |
| 5,277,234 | A | 1/1994 | Warstler | |
| 5,385,180 | A * | 1/1995 | Wittman | B67C 11/02 141/106 |
| 5,472,025 | A | 12/1995 | Conrad et al. | |
| 5,787,944 | A | 8/1998 | Sarkis et al. | |
| 5,921,296 | A * | 7/1999 | Porter | B67C 11/02 141/331 |
| 6,116,299 | A | 9/2000 | Cummins et al. | |
| 6,142,193 | A | 11/2000 | Sanders | |
| 6,425,424 | B1 * | 7/2002 | Ellis Calvo | B65B 39/00 141/331 |
| 7,013,934 | B1 * | 3/2006 | Hicok | B67C 11/00 141/297 |
| 7,284,581 | B2 * | 10/2007 | Steinweg | B67C 11/04 141/331 |
| 7,770,614 | B2 * | 8/2010 | Ben Shlomo | B67C 11/04 141/1 |
| 7,874,326 | B1 * | 1/2011 | Harvey | B65B 39/001 141/330 |
| 8,011,396 | B1 | 9/2011 | Harvey | |
| 8,567,456 | B1 * | 10/2013 | Francis | B67C 11/02 141/286 |
| 8,875,754 | B2 * | 11/2014 | Eyre | B67C 11/00 141/338 |
| D750,677 | S * | 3/2016 | Liao | D15/150 |
| 2007/0186995 | A1 * | 8/2007 | Steinweg | B67C 11/04 141/338 |
| 2008/0023104 | A1 * | 1/2008 | Steinweg | B67C 11/04 141/344 |
| 2013/0056505 | A1 | 3/2013 | Cress | |
| 2013/0313291 | A1 | 11/2013 | Gascoine | |

FOREIGN PATENT DOCUMENTS

| | | | |
|---|---|---|---|
| EP | 1120354 | A9 | 8/2001 |

OTHER PUBLICATIONS

Zep Screw on Funnel, http://www.exnop.com/zepscrewonfunnel/, Feb. 6, 2015.

HPLC Waste Line Adapters for ECO Funnels, http://www.calpaclab.com/hplcattachments/, Feb. 6, 2015.

* cited by examiner

*Primary Examiner* — Nicolas A Arnett
(74) *Attorney, Agent, or Firm* — George A. Leone; Citadel Patent Office

(57) ABSTRACT

A funnel system for transferring liquids from a dispenser to a receptacle including a mouth end and a smaller outlet end the funnel formed as a hollow conical portion with an angled wall having a rim around the mouth end, the outlet end is perpendicular to a central axis running vertically through the center of the funnel. A vent channel runs through the interior of the wall to a vent opening inside the hollow conical portion, where the vent channel includes an inlet port. A set of cams are located at preselected points and adapted to mate with a set of collars having threads sized to thread onto a selected receptacle having a threaded inlet and fixedly engage the receptacle inlet.

20 Claims, 5 Drawing Sheets

FUNNEL SYSTEM WITH INTERCHANGEABLE COLLARS

TECHNICAL FIELD

The present invention relates to funnels for transferring liquids from a dispenser to a receptacle in general, and, more particularly, to a funnel system with interchangeable collars for connecting to containers having connectors of different sizes and types.

BACKGROUND

With the proliferation of large warehouse shopping centers, consumers began buying foodstuffs in bulk on a regular basis. For example, condiments like ketchup, mustard and mayonnaise are often purchased in large bulky containers. While buying in bulk typically saves consumers money, the large containers are inconvenient to store, handle and transport in many instances. For example, smaller containers are preferred for table settings or for carrying to a picnic lunch. As a result, many people would prefer to have the best of both worlds by buying in bulk but also having the ability to transfer the contents of the bulk container to a smaller, more convenient container without undue effort. In some cases, consumers can realize savings of up to 80% by refilling bottles they've already purchased.

Unfortunately, most transfer devices, including funnels or pour caps are difficult to use and require one hand to steady the funnel in the receptacle while the other hand holds the dispenser. Further, different types of liquids, including especially viscous liquids like ketchup and mustard typically have various sized container connectors. While some purportedly universal funnel adapters have been previously made available, these are not particularly useful for viscous materials. For example, U.S. Pat. No. 5,472,025 issued Dec. 5, 1995 to Conrad et al. describes an adapter with threaded openings. Unfortunately, it lacks a venting function which is extremely important for preventing clogging when transferring viscous liquids from a dispenser into a container.

Other systems have external vents, like ribs on a funnel. However, such systems are not stable as they cannot be firmly affixed to a receptacle connector and leave an open space between the funnel and the outer ring of the receptacle inlet.

Thus, there is needed a universal funnel system which allows the user to easily transfer liquids from a large container to a smaller container without undue spillage or slow transfer of viscous liquids. The present disclosure provides new and novel solutions to overcome problems inherent in the prior art. A funnel system with a set of interchangeable collars is provided herein to overcome the deficiencies in the prior art.

BRIEF SUMMARY OF THE DISCLOSURE

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

A funnel system for transferring liquids from a dispenser to a receptacle is disclosed. It includes a funnel including a mouth end and a smaller outlet end where the funnel is formed as a hollow conical portion with an angled wall having a rim around the mouth end. The outlet end is perpendicular to a central axis running vertically through the center of the funnel. A vent channel runs through the interior of the wall to a vent opening inside the hollow conical portion, where the vent channel includes an inlet port. The angled wall terminates above the outlet end in a band having a bottom surface parallel to the funnel outlet. A set of cams are located at preselected points around the band. The bottom surface of the band is offset above the outlet end. The wall tapers to a bottom angled portion between the band and the outlet end. A set of collars is adapted to mate with the funnel outlet, each collar including a collar opening sized to match the outlet of the funnel, each collar including a set of cam attachment slots adapted to receive the set of cams, wherein at least one of the collars includes a venting port located to be aligned with the vent channel inlet port when the funnel is fixed into a collar and offset to be in fluid communication with a receptacle, and each collar has a set of threads sized to thread onto a selected receptacle having a threaded inlet and fixedly engage the receptacle inlet.

In one aspect the set of cams includes a keyed cam sized larger than the others for alignment purposes.

In another aspect the set of cams comprises at least three cams positioned at predetermined intervals around the band.

In another aspect the set of cams comprises at least three cams positioned at 120° intervals around the band.

In another aspect each collar includes an angled top surface around the circumference of the collar.

In another aspect the set of cam attachment slots are located around the angled top surface so as to accept the set of cams.

In another aspect a seating bezel surrounds the collar opening, where, juxtaposed between the seating bezel and the angled top surface is a ring having a flat surface adapted for seating the funnel band.

In another aspect one of the attachment slots is sized differently than the others to accept the keyed cam.

In another aspect the wall tapers to a bottom angled portion inclined obliquely to the upper portion of the wall.

Other features, benefits and advantages of the present invention will become apparent from the disclosure, claims and drawings herein.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
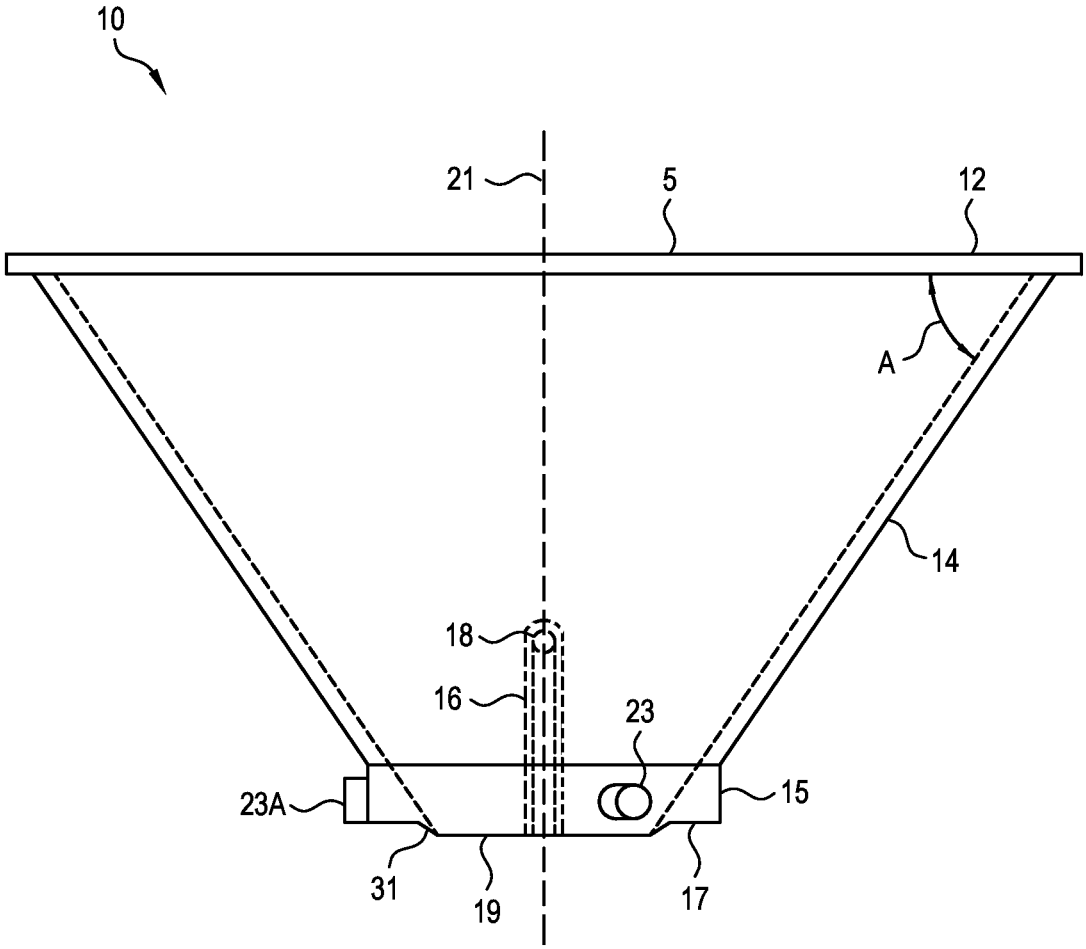
FIG. 1 schematically shows an example of a funnel with an internal vent.

In the drawings, identical reference numbers identify similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not intended to convey any information regarding the actual shape of the particular elements, and have been solely selected for ease of recognition in the drawings.

DETAILED DESCRIPTION OF THE PREFERRED EMBODIMENTS

The following disclosure describes several embodiments and systems for a locking cover. Several features of methods and systems in accordance with example embodiments are set forth and described in the Figures. It will be appreciated that methods and systems in accordance with other example embodiments can include additional procedures or features different than those shown in the Figures. Example embodiments are described herein with respect to a two piece funnel system. However, it will be understood that these examples are for the purpose of illustrating the principles, and that the invention is not so limited. Additionally, methods and systems in accordance with several example embodiments may not include all of the features shown in the Figures.

Unless the context requires otherwise, throughout the specification and claims which follow, the word "comprise" and variations thereof, such as, "comprises" and "comprising" are to be construed in an open, inclusive sense that is as "including, but not limited to."

Reference throughout this specification to "one example" or "an example embodiment," "one embodiment," "an embodiment" or various combinations and variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Referring now to FIG. 1, an example of a funnel with an internal vent is schematically shown. A funnel 10 includes a mouth end 5 and a smaller outlet end 19. The funnel 10 may advantageously be formed as a hollow conical portion with an angled wall 14 having a rim 12 around the mouth end 5. A vent channel 16 runs through the wall to a vent opening 18. The vent channel 16 is enclosed within the wall. The bottom of the angled wall 14 terminates in a band 15 having a bottom surface 17 parallel to the outlet end 19. The outlet end 19 is perpendicular to a central axis running vertically through the center of the funnel 21. A set of cams 23 are located at preselected points around the band 15. The bottom surface 17 of the band 15 is slightly offset above the outlet end 19 where the wall tapers to a bottom angled portion 31, where the bottom angled portion may be inclined obliquely to the upper portion of the wall.

In one useful example, the set of cams 23 may be positioned at 120° intervals around the band 15. Different numbers of cams may be used as necessary for a particular application. In one example a key cam 23A may have a width of about 6 mm while the other cams have a width of about 4 mm. The cams may protrude about 4 mm more or less from the side wall of band 15. In one useful embodiment the interior angle A of the wall 14 may be disposed at about at least 57° relative to the rim 12. The wall 14 may advantageously be made of a thickness suitable for locating vent channel 16 within the wall 14. In one example, the wall 14 may advantageously have a thickness of at least about 2 mm. The vent opening 18 opens to the inside of the funnel. In one example the bottom angled portion 31 may be angled at 30° relative to a horizontal plane parallel with the funnel outlet, compared to an angle of about 57° for the upper portion of the wall above the outer band 15.

Figure 2:
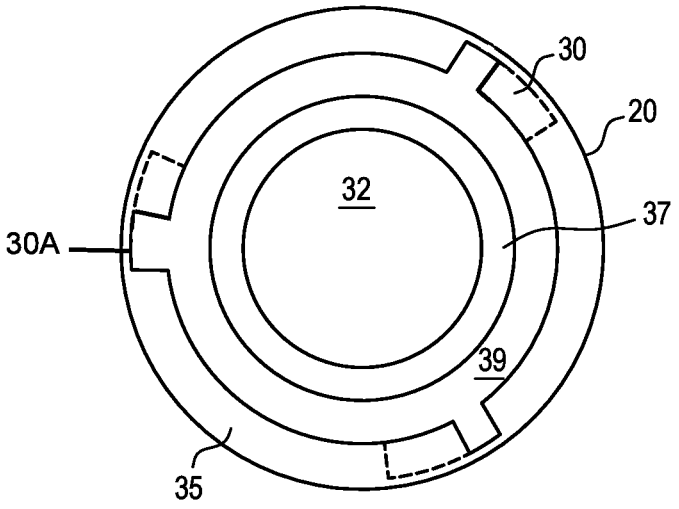
FIG. 2 schematically shows a top view of a collar adapted to mate with a funnel made in accordance with the present disclosure.

Referring now to FIG. 2, a top view of a collar adapted to mate with the funnel made in accordance with the present disclosure is schematically shown. A collar 20 includes a set of cam attachment slots 30 adapted to receive the set of cams 23. The collar 20 has a collar opening 32 sized to match the outlet of the funnel. In one useful example, the set of cams includes at least one cam sized larger than the others for alignment purposes. By using at least one uniquely sized or shaped cam 23A (as shown in FIG. 1), proper alignment of the funnel with the collar is assured. This is needed when aligning the funnel with a venting port as described herein below.

The collar 20 further includes an angled top surface 35 around the circumference of the collar. The set of cam attachment slots 30 are located around the angled top surface so as to accept the set of keyed cams 23 in only one orientation as determined by the key cam. That is only one of the slots can accommodate the key cam 23A. The collar 20 further includes a seating bezel 37 surrounding the opening 32. Juxtaposed between the seating bezel 37 and the angled top surface 35 is a ring 39 having a flat surface for seating the funnel band 17. The angled top surface 35 is advantageously inclined to mate with the funnel wall 14. The band 15 fits into opening 32 and allows the angled surface of the funnel 31 to seat onto the bezel 37.

Figure 3:
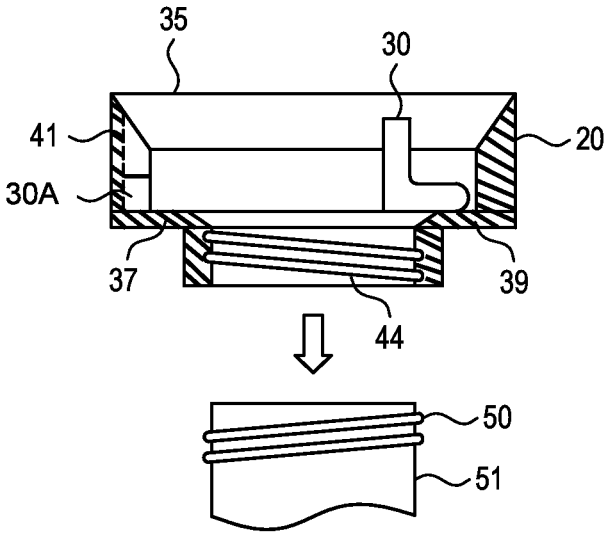
FIG. 3 schematically shows a cutaway side view of a collar adapted to connect to a funnel and a receptacle top connector.

Referring now to FIG. 3, a cutaway side view of a collar adapted to connect to a funnel and a receptacle top connector is schematically shown. The collar 20 includes an internally threaded portion 44 centrally located and protruding from the bottom of the flat surface 39 the end of the cam locking area 30A is indicated by line 41. The externally threaded portion 50 of a receptacle 51 is shown in relationship to the cover 20. In use, the cover 20 is threaded onto the receptacle so as to be fixedly engaged. The bezel 37 is angled downwardly to match the angled bottom portion 31 of the funnel wall. The bezel 37 is angled at a complementary angle to the bottom portion of the wall 14 below the band 15. In one useful example, the bezel is angled at a complementary angle of 60° to accept the funnel which is angled at its bottom portion at about 30°.

Figure 4:
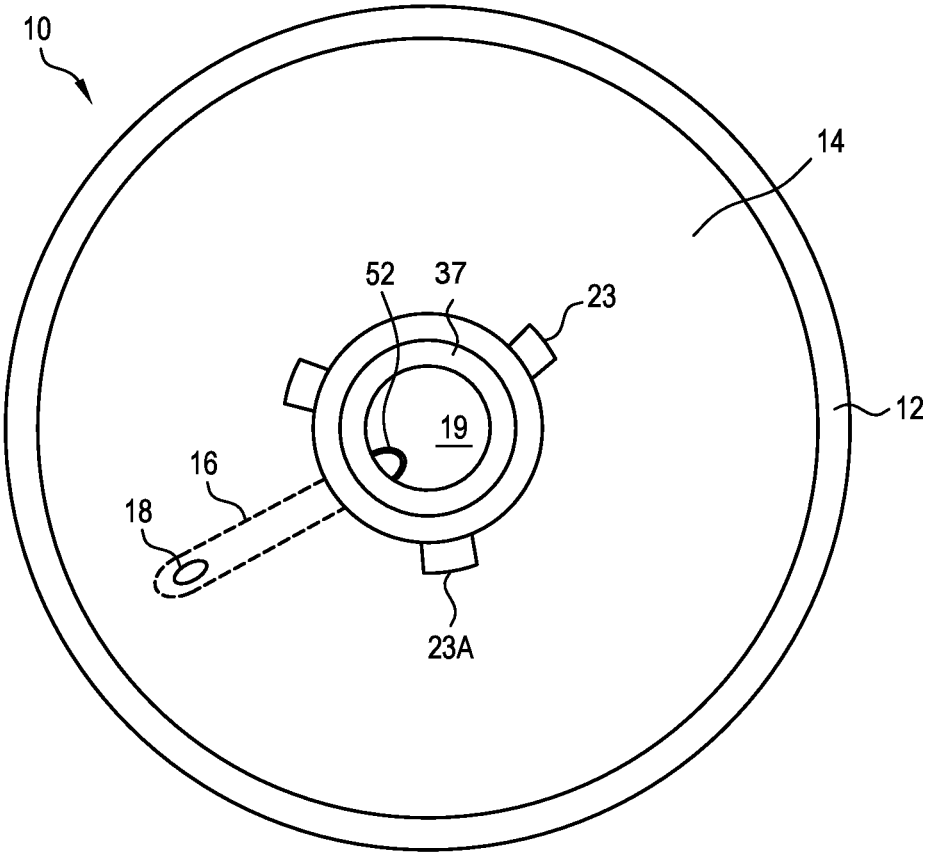
FIG. 4 schematically shows a bottom view of an example of a funnel with an internal vent.

Referring now to FIG. 4, a bottom view of an example of a funnel with an internal vent is schematically shown. The funnel 10 has a channel inlet 52 in fluid communication with the pressure relief vent 18. The channel inlet 52 may advantageously be located between any two of the set of cams 23. The channel inlet 52 is located in the bottom outlet end 19 and may advantageously be a protruding external channel in fluid communication with the enclosed pressure relief vent channel 16.

Figure 5:
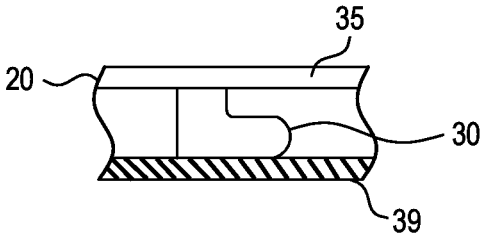
FIG. 5 schematically shows a cutaway side view of an example of an attachment slot for a funnel tab.

Referring now to FIG. 5, a cutaway side view of an example of an attachment slot for a funnel tab is schematically shown in more detail. An attachment slot 30 is located within a collar 20 between the flat surface ring 39 and the angle top surface 35. Each attachment slot 30 is sized to accept and lock in one of the set of cams. One of the attachment slots is sized differently to accept the keyed cam.

Figure 6:
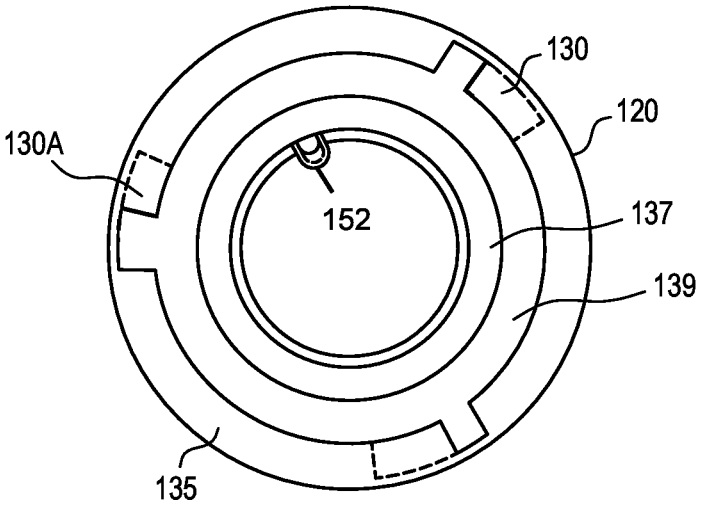
FIG. 6 schematically shows a top view of an alternative example of a collar including a vent port.

Referring now to FIG. 6 a top view of an alternative example of a collar including a vent port is schematically shown. The collar 120 is constructed substantially similarly to the collar 20 as described above. One difference is that the collar 120 includes a venting port 152. Otherwise, as above, the collar 120 includes a set of cam attachment slots 130 adapted to receive a set of cams. The collar 120 has an opening 132 sized to match the opening of the funnel. In one useful example, the set of slots 130 includes at least one slot 130A sized larger than the others for alignment purposes. By using at least one uniquely sized or shaped cam, proper alignment of the funnel with the collar is assured. This needed when aligning the funnel with a venting port as described herein below.

The collar 120 further includes an angled top surface 135 around the circumference of the collar. The openings of the set of cam attachment slots 130 are located around the angled top surface so as to accept the set of cams on the funnel. The collar 120 further includes a seating bezel 137 surrounding the opening 132. Juxtaposed between the seating bezel 137 and the angled top surface 135 is a ring 139 having a flat surface for seating the funnel band.

The venting port 152 is located to align with inlet 52 when the funnel is attached to the collar. Inlet 52 is, in turn, in fluid communication with internal pressure relief vent channel 16. Use of the venting port 152 is particularly advantageous when pouring viscous liquids into a receptacle having an opening having an area that clogs due to reduced air pressure differences to slow down the transfer of the liquid from the dispenser into the receptacle.

Figure 7:
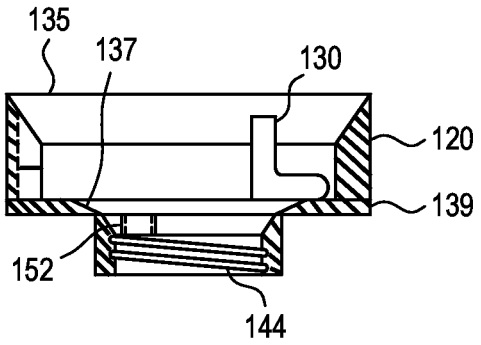
FIG. 7 schematically shows a cutaway side view of an alternative example of a collar including a vent port as in FIG. 6.

Referring now to FIG. 7, a cutaway side view of an alternative example of a collar including a vent port as in FIG. 6 is schematically shown. As stated above, the cover 120 includes a pressure relief venting port 152 which is located to be aligned to the pressure relief channel opening 52 in the funnel when the funnel is attached to the collar as keyed by the set of cams being locked into the set of attachment slots 152. As above, the cover 120 includes internal threads 144. In use, the pressure relief venting port 152 is offset so as to be in fluid communication with the receptacle when the cover is threaded onto the receptacle.

Figure 8:
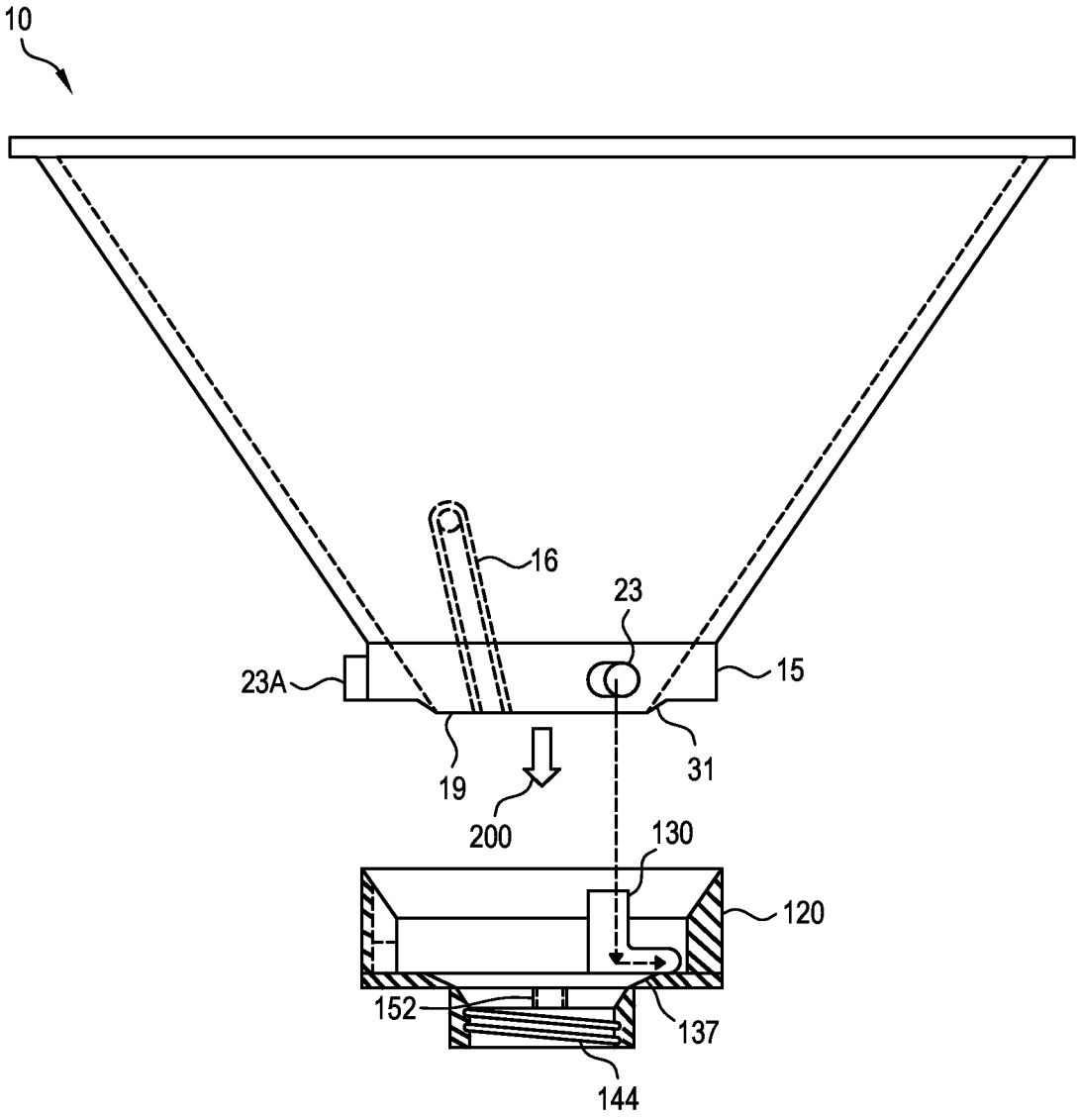
FIG. 8 schematically shows an example of a funnel with an internal vent in relationship to a mating collar as a cutaway half view.

Referring now to FIG. 8, an example of a funnel with an internal vent in relationship to a mating collar is schematically shown as a cutaway half view. The funnel 10 is aligned to be coupled to a cover 120. The funnel is then inserted into the cover 120 so that the bottom angled portion 31 seats on seating bezel 137 and the set of cams 14 are slotted into a corresponding set of slots 130. Once the funnel is fully seated, it may be rotated in a counterclockwise manner (or clockwise manner as the case may be) to lock the funnel into place and align it with the venting port 152. Having attached the funnel to the collar, the collar may now be attached to a matching receptacle. Once all the connections have been made a transfer of liquid can be carried out from a dispenser to the receptacle. To detach the funnel, the above steps are reversed.

Having described the components of the funnel system it is now considered beneficial to the understanding of the invention to describe its operation and use. The two-part funnel system as disclosed allows a master funnel to be connected to a series of collars that fit various size openings. This funnel system eliminates the need for having several funnels with various sized openings to fill containers having various sized openings. The funnel system incorporates an internal pressure relief vent in the master funnel as well as one of the collars that lineup when attached together. The collars use a screw thread to secure themselves onto the receptacle. This allows hands-free operation of the funnel once it is secured. This also makes the funnel spill resistant, since the container, if knocked over, cannot fall completely over. The collars are designed to fit precisely over the container to be filled and the mouth of the collar the same size as the mouth of the container. This, in conjunction with the pressure relief vent, allows even highly viscous materials to flow more easily into a receptacle.

As far as the materials to be used to make the funnel, it can be made from a plastic material, nylon, silicone, metal, any combination thereof or equivalents. The method for making the funnel can be any commercially known process such as injection molding, metal extrusion, a combination of those manufacturing processes or equivalents.

The invention has been described herein in considerable detail in order to comply with the Patent Statutes and to provide those skilled in the art with the information needed to apply the novel principles of the present invention, and to construct and use such exemplary and specialized components as are required. However, it is to be understood that the invention may be carried out by specifically different equipment, and devises, and that various modifications, both as to the equipment details and operating procedures, may be accomplished without departing from the true spirit and scope of the present invention.

For example, the funnel system is completely scalable. The funnel size and size of the collars will be determined by the applications it will be used for. Further, other connection systems may be employed as evident to those skilled in the art having the benefit of this disclosure.

What is claimed is:

1. A funnel system for transferring liquids from a dispenser to a receptacle, the funnel system comprising:

a funnel including a mouth end and a smaller outlet end the funnel formed as a hollow conical portion with an angled wall having a rim around the mouth end, the outlet end is perpendicular to a central axis running vertically through the center of the funnel;

a vent channel runs through the interior of the wall to a vent opening inside the hollow conical portion, where the vent channel includes an inlet port;

the angled wall terminates above the outlet end in a band having a bottom surface parallel to the funnel outlet;

a set of cams are located at preselected points around the band;

the bottom surface of the band is offset above the outlet end;

the wall tapers to a bottom angled portion between the band and the outlet end;

a set of collars adapted to mate with the funnel outlet, each collar including a collar opening sized to match the outlet of the funnel, and each collar including a set of cam attachment slots adapted to receive the set of cams, wherein at least one of the collars includes a venting port located to be aligned with the vent channel inlet port when the funnel is fixed into a collar and offset to be in fluid communication with a receptacle; and each collar having a set of threads sized to thread onto a selected receptacle having a threaded inlet and fixedly engage the receptacle inlet.

2. The funnel system of claim 1 where the set of cams includes a keyed cam sized larger than the others for alignment purposes.

3. The funnel system of claim 2 where one of the attachment slots is sized differently than the others to accept the keyed cam.

4. The funnel system of claim 1 where the set of cams comprises at least three cams positioned at predetermined intervals around the band.

5. The funnel system of claim 1 where the set of cams comprises at least three cams positioned at 120° intervals around the band.

6. The funnel system of claim 1 where each collar includes an angled top surface around the circumference of the collar; the set of cam attachment slots are located around the angled top surface so as to accept the set of cams; a seating bezel surrounding the opening; where, juxtaposed between the seating bezel and the angled top surface is a ring having a flat surface adapted for seating the funnel band.

7. The funnel system of claim 1 where the wall tapers to a bottom angled portion inclined obliquely to the upper portion of the wall.

8. The funnel system of claim 1 wherein the funnel and collars are made from materials selected from the groups consisting of plastic, nylon, silicone, metal, and combinations thereof.

9. A funnel system for transferring liquids from a dispenser to a receptacle, the funnel system comprising:

a funnel including a mouth end and a smaller outlet end the funnel formed as a hollow conical portion with an angled wall having a rim around the mouth end, the outlet end is perpendicular to a central axis running vertically through the center of the funnel, where the wall tapers to a bottom angled portion inclined obliquely to the upper portion of the wall;

a vent channel runs through the interior of the wall to a vent opening inside the hollow conical portion, where the vent channel includes an inlet port;

the angled wall terminates above the outlet end in a band having a bottom surface parallel to the funnel outlet;

a set of at least three cams are located at preselected points around the band where the set of at least three cams includes a keyed cam sized larger than the others for alignment purposes;

the bottom surface of the band is offset above the outlet end;

the wall tapers to a bottom angled portion between the band and the outlet end;

a set of collars adapted to mate with the funnel outlet, each collar including a collar opening sized to match the outlet of the funnel, each including a set of cam attachment slots adapted to receive the set of cams, wherein at least one of the collars includes a venting port located to be aligned with the vent channel inlet port when the funnel is fixed into a collar and offset to be in fluid communication with a receptacle;

where each collar includes a collar opening sized to match the outlet of the funnel, an angled top surface around the circumference of the collar, the set of cam attachment slots are located around the angled top surface so as to accept the set of cams, a seating bezel surrounding the opening, where, juxtaposed between the seating bezel and the angled top surface is a ring having a flat surface adapted for seating the funnel band; and each collar has a set of threads sized to thread onto a selected receptacle having a threaded inlet and fixedly engage the receptacle inlet.

10. The funnel system of claim 9 where the set of cams comprises at least three cams positioned at 120° intervals around the band.

11. The funnel system of claim 9 where one of the attachment slots is sized differently than the others to accept the keyed cam.

12. The funnel system of claim 9 where the wall tapers to a bottom angled portion inclined obliquely to the upper portion of the wall.

13. A kit for a funnel system for transferring liquids from a dispenser to a receptacle, the funnel system comprising:

a funnel including a mouth end and a smaller outlet end the funnel formed as a hollow conical portion with an angled wall having a rim around the mouth end, the outlet end is perpendicular to a central axis running vertically through the center of the funnel, a vent channel runs through the interior of the wall to a vent opening inside the hollow conical portion, where the vent channel includes an inlet port, the angled wall terminates above the outlet end in a band having a bottom surface parallel to the funnel outlet, a set of cams are located at preselected points around the band, the bottom surface of the band is offset above the outlet end, the wall tapers to a bottom angled portion between the band and the outlet end; and a set of collars adapted to mate with the funnel outlet, each collar including a collar opening sized to match the outlet of the funnel, a set of cam attachment slots adapted to receive the set of cams, wherein at least one of the collars includes a venting port located to be aligned with the vent channel inlet port when the funnel is fixed into a collar and offset to be in fluid communication with a receptacle; and each collar having a set of threads sized to thread onto a selected receptacle having a threaded inlet and fixedly engage the receptacle inlet.

14. The kit of claim 13 where the set of cams includes a keyed cam sized larger than the others for alignment purposes.

15. The kit of claim 14 where one of the attachment slots is sized differently than the others to accept the keyed cam.

16. The kit of claim 13 where the set of cams comprises at least three cams positioned at predetermined intervals around the band.

17. The kit of claim 13 where the set of cams comprises at least three cams positioned at 120° intervals around the band.

18. The kit of claim 13 where each collar includes an angled top surface around the circumference of the collar; the set of cam attachment slots are located around the angled top surface so as to accept the set of cams; a seating bezel surrounding the collar opening; where, juxtaposed between the seating bezel and the angled top surface is a ring having a flat surface adapted for seating the funnel band.

19. The kit of claim 13 where the wall tapers to a bottom angled portion inclined obliquely to the upper portion of the wall.

20. The kit of claim 13 wherein the funnel and collars are made from materials selected from the groups consisting of plastic, nylon, silicone, metal, and combinations thereof.

* * * * *